United States Patent [19]

Howell

[11] 4,043,456

[45] Aug. 23, 1977

[54] DIVIDERS AND PARTITIONS FOR SAME

[75] Inventor: James B. Howell, Woodcliff Lake, N.J.

[73] Assignee: Advertising Displays Corporation, Englewood, N.J.

[21] Appl. No.: 713,903

[22] Filed: Aug. 12, 1976

[51] Int. Cl.[2] ..... B65D 7/24; B65D 25/04

[52] U.S. Cl. ..... 211/184; 108/61; 312/140

[58] Field of Search ..... 211/184, 43; 312/140.3, 312/140.4, 140, 257 A; 108/61, 27; 220/22.1, 22

[56] References Cited

U.S. PATENT DOCUMENTS

| | | | |
|---|---|---|---|
| 848,582 | 3/1907 | Wallace | 211/184 |
| 1,277,340 | 8/1918 | Hormes | 211/43 UX |
| 1,768,379 | 6/1930 | Smith | 211/43 UX |
| 3,011,675 | 12/1961 | Zacharias | 220/22 |
| 3,381,782 | 5/1968 | Ikelheimer | 220/22 X |
| 3,472,945 | 10/1969 | Trachtenberg | 220/22 X |
| 3,672,531 | 6/1972 | Balven | 220/22 X |

*Primary Examiner*—J. Franklin Foss

[57] ABSTRACT

A vertical plastic straight wall divider for compartments and shelves which cannot be removed unless the goods lined up against the divider in the compartment are removed; said divider permits cold air flow between the compartments when used in freezers. Partitions may be attached on said divider, if desired, either on one or both sides thereof; if the partitions are used on both sides they are locked onto said divider.

1 Claim, 9 Drawing Figures

DIVIDERS AND PARTITIONS FOR SAME

BACKGROUND OF THE INVENTION

It is well known that space in stores, especially in supermarkets, is at a premium and many distributors and manufacturers provide such stores with free dividers for separating goods stored in freezer compartments and on shelves. Such dividers are generally made of cardboard which wear rapidly, do not last too long and may readily be damaged and removed. Also, such dividers are not locked in position in the compartments and are held in their vertical positions by stacking the goods against them.

The larger stores, such as the supermarkets, have thousands of items on display in freezer compartments, known as coffin type freezers. Since the upper part of the divider has space to carry the trademark or name of the manufacturer or distributor of the goods, it is highly desirable to place these dividers into the compartments and on the shelves in stores where such goods are sold so that the goods are advertised directly at the place where such goods are sold, known in the advertising field as "point of sales".

It is common practice for sales representatives of competing brands to mutilate, destroy or remove dividers of competitors and substitute dividers which carry their own name or brand. By mutilating dividers of others, they often convince the managers of the stores to permit their own dividers to be used. This practice is used both for the larger dividers used in the coffin type freezer and for the smaller divider used in upright freezers with lower shelves, known in the trade as "gondola shelves".

It is therefore important to provide a strong divider which cannot be mutilated, marred or readily removed from the compartments, especially by representatives of competitors.

OBJECTS OF THE INVENTION

I have provided a straight wall plastic divider of uniform thickness which can be inexpensively produced by injection molding, preferably with high impact plastic which is difficult to marr or destroy and which cannot be easily removed from the compartment unless virtually all of the goods within the compartment is removed. It is hardly likely that a representative of a competitor will remove all the goods within a compartment in order to remove the dividers and substitute the dividers bearing the name or brand of the company which employs him.

Furthermore, I have provided partitions which may be attached anywhere along the length of the divider, either on one side of the divider or on both sides thereof. If the partitions are attached to the divider on both, or opposite sides, such partitions are practically locked into position on the divider.

By providing a uniform series of aligned rectangular openings on the divider, such openings serve several purposes. First, the partitions may be spaced anywhere along the divider in order to accommodate goods within different sized containers and spaced to take the desired number of such containers. Second, the uniform thickness of the divider and the openings permit attachment of the partitions and the locking in thereof by means hereinafter described. Third, the openings in the divider permit the free flow of cold air through the divider openings and the various compartments.

Fourth, the dividers are so constructed that they cannot be readily removed from the loaded freezer or compartment thus preventing pilferage of the dividers by competitors.

For a fuller understanding of the nature, objects and advantages of the invention reference is made to the following specification and the accompanying drawings.

DESCRIPTION OF THE PREFERRED EMBODIMENTS OF THE INVENTION

Figure 3:
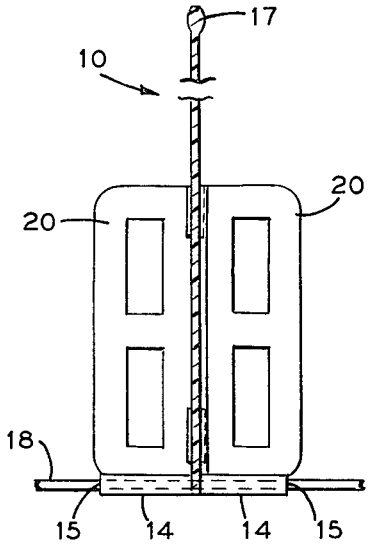
FIG. 3 is a section taken through line 3—3 of FIG. 1.
Figure 1:
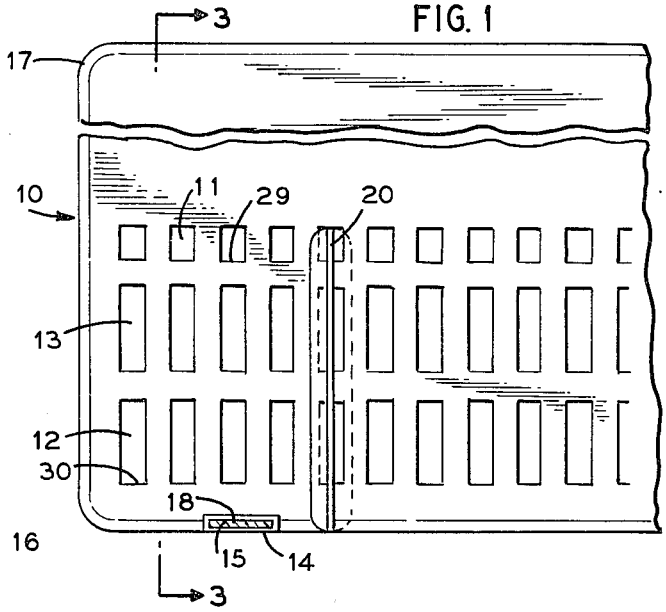
FIG. 1 is a front elevational view, partly broken away, of a divider showing the openings thereon, the projections or extensions at its base through which a plastic strap is passed and the partitions attached thereto.
Figure 2:
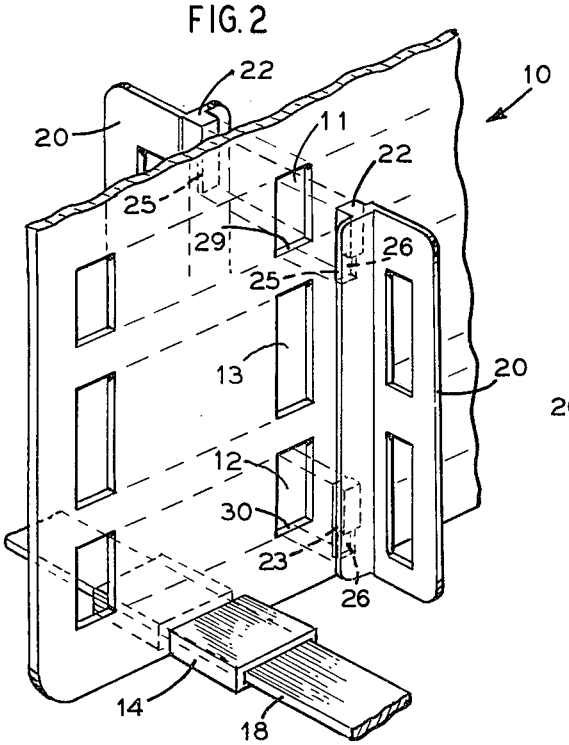
FIG. 2 is a perspective view, partly broken away, of the divider shown in FIG. 1, showing a partition about to be inserted into the upper and lower openings of the divider and a strap passed through one of the extensions at the base of the divider.

Referring to the drawing, numeral 10 represents a divider, preferably made of high impact plastic, the body of which is of uniform thickness and has a series of uniform openings 11 adjacent the upper longitudinal portion and a series of uniform openings 12 adjacent the lower longitudinal portion for reasons hereinafter described. The divider 10 may have additional openings, such as 13, between the openings 11 and 12 to permit the flow of cold air therethrough when the divider 10 is used in freezer compartments to divide such freezer compartments into smaller compartments. The openings 11 and 12 also permit the free flow of air between the freezer compartments. Openings 11 and 12 are preferably of a rectangular configuration. The divider 10 has one or more rectangular extensions 14 at the base thereof through which there is a rectangular opening 15. The corners 16 of divider 10 are preferably rounded and the edge of the divider is preferably arcuately beaded as shown at 17 to avoid sharp edges on which a customer may scratch or injure his hands or arms. Straps 18, preferably of flat flexible extruded plastic material, of a size to pass through rectangular openings 15, are provided of any desired length to fit into any size compartment and may pass through openings 15 of a series of dividers placed parallel to each other in such compartment. When straps 18 are inserted through openings 15 of extensions 14 of the dividers 10, the dividers will remain in vertical and upright position in the compartment and such dividers may be moved along the straps 18 to divide the compartment into any desired number of sections and size thus formed. When cans, packed goods, containers of goods and the like are stacked between the dividers 10 and upon the straps 18, it would be very difficult to remove the dividers 10 without removing virtually all of the packaged goods stacked between the dividers since the dividers are locked in position by the straps 18 on the bottom of the compartment. If desired, the extensions 14 with its opening 15 may be eliminated and rectangular openings (not shown) may be made adjacent the base of the divider through which straps 18 may be passed. Dividers for freezers at the present time are generally made in standard lengths of 27 inches and 13 inches in height. However, the dividers of this invention may be made in any desirable length and height.

Figure 4:
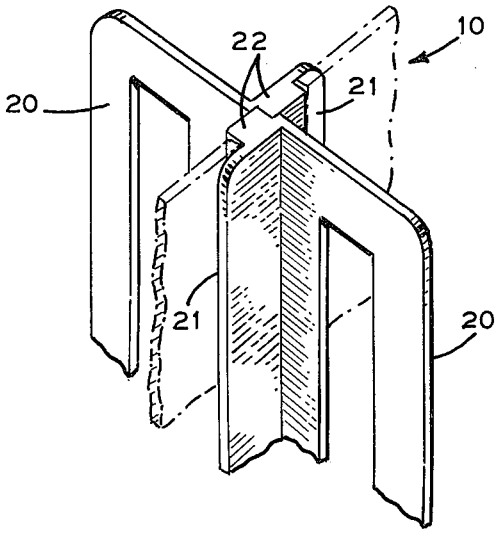
FIG. 4 is an enlarged perspective view of two of the partitions, partly broken away, showing the manner of placing them together when positioned in an upper and lower opening of the divider.
Figure 5:
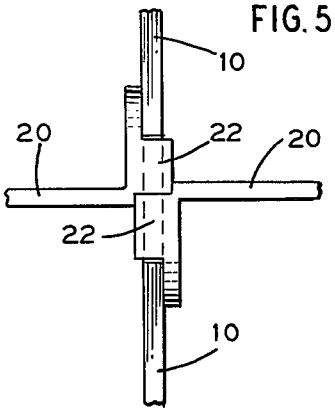
FIG. 5 is a top view of the partitions shown in FIG. 4, partly broken away, showing the manner of such partitions seated on the divider.
Figure 8:
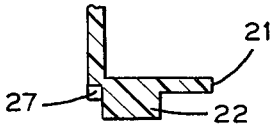
FIG. 8 is sectional view taken through line 8—8 of FIG. 7.
Figure 7:
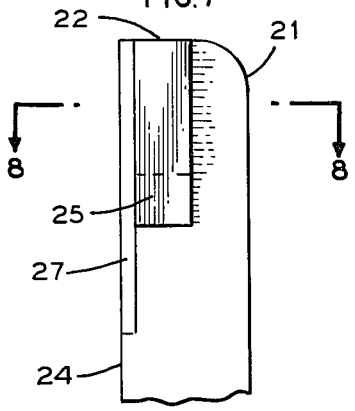
FIG. 7 is an enlarged edge view of the upper part of the partition, partly broken away, shown in FIG. 6.
Figure 6:
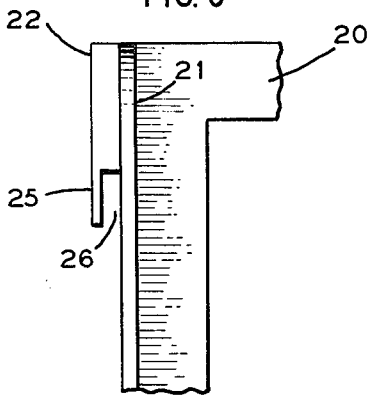
FIG. 6 is an enlarged side view of the upper part of a partition, partly broken away, showing one of the extensions for interlocking the partition to the divider.

Partitions 20, also preferably made of a tough plastic material such as high impact styrene, are provided which may be easily attached to the divider 10 to furthr divide or partition the compartments formed by the dividers 10. Partition 20 is a thin straight wall partition of rectangular configuration having a narrow flange 21 at right angles to the partition. Flange 21 is preferably made the full length of the partition and has a narrow top projection 22, and bottom projection 23 spaced slightly inwardly from edge 24. Each of the projections 22, 23 has a downwardly projecting extension 25 forming a narrow slot 26 between such projection and flange 21 which is about the thickness of the divider 10. A right angle upper groove 27 extends downwardly a sufficient distance and a similar reverse bottom right angle groove extends upwardly a sufficient distance to permit projections 22 to abut one another as shown in FIG. 4 and 5.

In order to attach partition 20 to divider 10, top and bottom projections 22, 23 are inserted into upper and lower openings 11, 12 of the divider 10, openings 11, 12 being somewhat higher than the length of top and bottom projections 22, 23 and projections 22, 23 are then slid downwardly so that the thickness of the divider passes into the top and bottom slots 26 and the extensions 25 hug the outer wall of the divider. There is sufficient flexibility in extension 25 to provide a tight sliding fit with the divider to retain the partition 20 firmly upon the divider 10 by frictional engagement.

In order to attach two partitions 20 in the same plane but on opposite sides of the divider 10, the projections 22, 23 of one partition 20 are inserted into upper and lower openings 11, 12 and slid downwardly as hereinbefore described attaching same to the divider and the projections 22, 23 of another or second similar partition 20 are inserted into the same openings 11, 12 in reverse position but on the other side of the divider and slightly higher, since the openings 11, 12 are of sufficient height and width to permit such insertion, and is then slid downwardly until the lower edges 29, 30 of upper and lower openings 11, 12 are reached and stop the second partition. The two opposed partitions are then aligned at the same height and are practically locked onto the divider 10 since the width of upper and lower openings 11, 12 are about the width of the combined width of the opposed projections 22. As hereinbefore mentioned, the groove 27 permits the projections 22, 23, when placed on opposite sides of the divider, to have their edges, which are adjacent edge 24 of the partition, abut one another thus practically aligning partitions 20 in the same plane.

Figure 9:
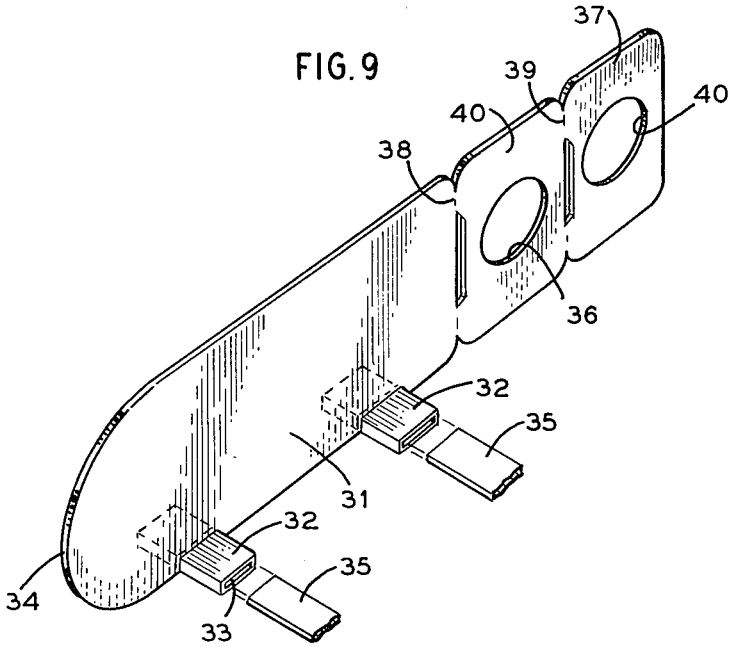
FIG. 9 is a perspective view of a smaller divider used in upright freezers with lower shelves, and also on shelves generally, showing the straps about to be inserted through the extensions at the base of the divider and the end portions which may be readily broken off the divider by bending same at a scoring line to reduce the length of the divider, if desired.

In FIG. 9, a smaller divider of a height lower than the larger divider hereinbefore described for the coffin type of freezer, is shown. This lower and smaller divider is generally used in upright freezers and the "gondola" type of shelves, as they are called in the supermarket trade. This divider 31 has one or more extensions 32 at the base thereof through which there is a rectangular opening 33. The front end 34 is preferably rounded to avoid any sharp corners which may injure the hands and arms of a customer that may reach in to obtain a can or container of goods. Straps 35, preferably of flat flexible plastic material, of a thickness and width to pass through rectangular openings 33, are provided of any desired length to fit into any size compartment or shelf and may pass through a series of such dividers 31 generally placed parallel to each other in such compartment or shelf. When straps 35 are placed through openings 33, these dividers will remain in vertical and in upright position on the shelf or in the compartment and such dividers may be moved along the straps 35 to divide the shelf or compartment into any desired number of subcompartments. When containers or canned goods are stacked between these dividers and upon the straps 35, it would be difficult by a representative of a competitor company to remove the divider without removing virtually all of the packaged goods stacked between the dividers. Dividers 31 are of additional length and have extensions 36, 37 which may be readily snapped or broken off at score lines 38, 39 by bending at such points one or more times. Also, openings 40 may be made in such extensions 36, 37 or in the body of divider 31 to permit greater flow of cold air if these dividers are used in freezers or on freezer shelves. Sufficient space is provided on these dividers for the manufacturer or distributor to place the name of some brand or trademark thereon.

It is to be understood that the dividers and partitions shown and described may be made in any desired color since these dividers may be made by the molded method. If made by die stamping, these dividers may also be made of sheet plastic of any desired color. Since plastics may be printed and screened with any desired emblems, trade names and brands in any desired colors and such methods of printing are well known, the arrangement of space on such dividers and the design and configuration of same may be varied to suit the person, firm or corporation that provides the dividers to the seller.

It is to be further understood that these dividers are not made for use only for supermarkets for use for frozen goods, but also for a large variety of stores and businesses that require the separation and display of goods, such as hardware stores, cosmetic shops, candy and confectionery stores, bake and cake stores, drug stores, health and beauty aid stores, department stores and the like. In fact, practically any store, warehouse or shop that has shelves for its goods.

I claim:

1. A straight wall substantially rectangular divider of uniform thickness for compartments, said divider comprising a uniform series of upper and lower aligned openings along the major part of said divider, at least one opening adjacent the base of said divider, at least one strap for insertion at a 90° angle through said base opening for locking said divider to said strap and to permit stacking of goods against said divider and upon said strap to prevent removal of said divider from said compartment, one or more partitions having means on one edge thereof for attaching said partition to said divider, said attaching means on said partition comprising upper and lower projections, said projections having extensions and a slot of about the thickness of said divider for passing said extensions through said upper and lower aligned openings in said divider and sliding said partition downwardly for attaching said partition to said divider, said partition having a right angle narrow extention at one longitudinal edge thereof from which said upper and lower extensions project, said extentions being slightly offset from the opposite face of said narrow extension to accommodate said similar upper and lower extensions of another partition of the same construction when placed in opposite position against the said upper and lower extensions of said first partition so that both opposed partitions may be attached to said divider and virtually locked within the openings of said divider.

* * * * *